United States Patent [19]

Cordry

[11] Patent Number: 5,046,568

[45] Date of Patent: Sep. 10, 1991

[54] DRIVEN GROUNDWATER SAMPLING DEVICE

[76] Inventor: Kent E. Cordry, 308 Mountaire Parkway, Clayton, Calif. 94517

[21] Appl. No.: 494,984

[22] Filed: Mar. 15, 1990

[51] Int. Cl.[5] ..... E21B 7/26

[52] U.S. Cl. ..... 175/21; 175/22; 175/59; 166/264; 73/155

[58] Field of Search ..... 166/264, 169; 175/20, 175/21, 22, 59, 308, 312; 73/155

[56] References Cited

U.S. PATENT DOCUMENTS

| | | | |
|---|---|---|---|
| 58,721 | 10/1866 | Duck et al. | 175/314 |
| 58,769 | 10/1866 | Bruen | 166/103 |
| 166,136 | 7/1875 | Patterson | 175/314 |
| 1,211,415 | 1/1917 | Cross | 175/22 |
| 1,489,916 | 4/1924 | Blamphin | 255/14 |
| 2,141,261 | 12/1938 | Clark | 166/21 |
| 2,374,227 | 4/1945 | Metcalf | 166/264 |
| 2,376,366 | 5/1945 | Lawlor et al. | 166/264 |
| 4,438,654 | 3/1984 | Torstensson | 166/264 |
| 4,526,230 | 7/1985 | Kojicic | 166/236 |
| 4,583,594 | 4/1986 | Kojicic | 166/236 |
| 4,649,996 | 3/1987 | Kojicic et al. | 166/236 |
| 4,669,554 | 6/1987 | Cordry | 175/59 |
| 4,804,050 | 2/1989 | Kerfoot | 175/20 |
| 4,807,707 | 2/1989 | Handley et al. | 175/20 |

OTHER PUBLICATIONS

Thompson et al, "Soil Gas Contaminant Investigations: A Dynamic Approach", Groundwater Monitoring Review (GWMR), Summer 1987, pp. 88-93.

*Primary Examiner*—Ramon S. Britts
*Assistant Examiner*—Roger J. Schoeppel
*Attorney, Agent, or Firm*—Christie, Parker & Hale

[57] ABSTRACT

A device for retrieving a groundwater sample is provided. The device includes an elonagated hollow housing, a closure assembly mounted on the top end of the housing, and a drive cone removably mounted on the bottom end of the housing. The drive cone is adapted to penetrate the ground and is configured to be restrained by the ground once in place below the ground surface, so that frictional engagement between the drive cone and housing is overcome when the closure assembly and housing are withdrawn toward the surface. Such withdrawal of the closure assembly and housing leaves the drive cone in place, separated from the housing. A collection and containment unit is mounted within the hollow housing and closure assembly for collecting a groundwater sample after the drive cone has been separated from the housing.

9 Claims, 3 Drawing Sheets

DRIVEN GROUNDWATER SAMPLING DEVICE

FIELD OF THE INVENTION

This invention relates to methods and devices useful for obtaining groundwater samples.

BACKGROUND OF THE INVENTION

There is an ever-increasing concern about pollution because of the damage it causes to the environment and to human health. One major type of pollution is caused by toxic waste entering and contaminating groundwater supplies. Because of the increased concern regarding groundwater pollution and its possible deleterious affect on the surrounding habitat and on potable water supplies, a large number of groundwater investigations are being conducted. Such groundwater investigations require the collection of water samples at various depths below the ground surface and bringing the samples to the surface for evaluation.

One method used to collect groundwater samples is to sink a permanent well into the ground and pump the water sample to the surface. Constructing permanent wells tends to be more expensive than desired because the equipment is used in only a single location and a separate well must be constructed at each desired sample point.

A second method of groundwater sampling is to take the sample with a device that is not left permanently in the ground, but, instead, is designed to be reused time after time at multiple locations. Such reusable devices incorporate a sample collection chamber (or hollow piping section) which is configured to be driven into the ground to a desired depth so that the water sample can be collected. Once the water sample is in the chamber, the sample is pumped to the surface, or the entire chamber is withdrawn to the surface, so that the sample can be tested.

Commonly, reusable groundwater sampling devices include a drive cone, which is designed to penetrate the earth, permanently mounted on a slotted sample tube configured to telescope within the bottom end of the sample chamber. The drive cone is in abutting relationship with the bottom of the sample chamber with the sample tube housed within the chamber as the device is being driven into the ground. After the device is driven to the desired depth, the sample chamber is withdrawn upwardly a small distance toward the ground surface while, at the same time, the drive cone remains in its original location due to frictional engagement with the ground. Thus, during the withdrawal operation, the sample tube is pulled from its housed position within the sample chamber to expose a portion of its length to the environment. When the sample tube is extended from the sample chamber, a pathway is open for water to flow through the sample tube slots and into the chamber. Some devices are configured so that the sample is pumped from the chamber to the ground surface and, after the sample is taken, the device, including the sample tube and drive cone, is withdrawn from the ground. Other devices are configured to be withdrawn to the ground surface for sample recovery.

In order for the above-described reusable sampling devices to operate properly, the sample tube must be free to slide into and out from the sample chamber during multiple uses and to be restrained within the chamber by a force that is less than the force which restrains the drive cone at its position in the ground. For example, if the sample chamber or the sample tube are bent out of alignment with each other, such that the sample tube is not appropriately free to slide within the chamber, the sample tube will not extend from the chamber, and sampling will not be possible. Thus, when the components are bent out of line, they must be repaired or replaced before the device is used.

Additionally, when groundwater samples are taken in low permeability cohesive soil, it is advantageous to maximize the area from which the water sample can be drawn. By maximizing the sample area, the speed with which the sample chamber fills can be shortened substantially with a resultant reduction in the cost for obtaining the sample. A limitation when using groundwater devices which incorporate sample tubes is that the area from which a sample can be taken is limited to the area along that portion of the length of the tube which extends out from the chamber into the ground. Because it is not practical to provide sample tubes longer than about 5 feet, the sample area can be less than desired when devices incorporating sample tubes are used in low permeability soil.

In view of the foregoing, it is desirable to provide a groundwater sampling device which (1) is of extremely simple construction, (2) minimizes or eliminates components which must maintain the ability to slide within each other in successive uses, and (3) is configured to be capable of maximizing the area from which a sample can be taken, particularly in low permeability cohesive soil.

SUMMARY OF THE INVENTION

There is provided, therefore, in accordance with practice of the present invention a device for retrieving a groundwater sample which is reusable and, yet, has no sample tube which must slide into and out from the sample chamber. Thus, the device provided in accordance with the present invention is extremely simple in construction and is not subject to having to be repaired because of a sample tube being bent out of line. Furthermore, the area from which the sample can be taken is not limited by sample tube length.

In one embodiment, the device of the present invention includes an elongated hollow housing, a closure assembly mounted on the top end of the housing, and a drive cone removably mounted on the bottom end of the housing. The drive cone is adapted to penetrate the ground and is configured to be restrained by the ground once in place below the ground surface, so that the frictional engagement between the drive cone and housing is overcome when the closure assembly and housing are withdrawn from the ground toward the surface. Such withdrawal of the closure assembly and housing leaves the drive cone in place, separated from the housing subsequent to the withdrawal. A sample collection and containment unit is mounted within the hollow housing and closure assembly. The collection and containment unit comprises an inlet assembly adjacent the bottom end of the housing spaced from and connected to an outlet assembly adjacent the top end of the housing. The space between the inlet and outlet assemblies defines a sample chamber. The inlet assembly includes a one-way check valve mounted downstream from the screen so that a water sample flows from the ground through the check valve and into the sample chamber when the drive cone has been separated from the housing. The outlet assembly includes a one-way check valve through which water can flow out from the sample chamber.

In an exemplary embodiment, the collection/containment unit is not permanently mounted within the housing but can easily be removed therefrom. Having a collection/containment unit which can be removed from the housing enables the unit to be repaired, if necessary, enables the housing to be used in other configurations without the unit, if desired, and enhances the ease of cleaning the device.

Once the sample is collected in the sample chamber, the device is withdrawn to the ground surface so that the sample can be collected and tested.

Another embodiment of a device provided in accordance with practice of principles of the invention comprises at least one elongated hollow piping section through which a groundwater sample can flow to the ground surface. A drive cone adapted to penetrate the ground is removably mounted by means of frictional engagement on the bottom end of the piping section. A quantity of permeable material fills at least a portion of the hollow piping section. The drive cone is configured to be restrained by the ground so that the frictional engagement between the drive cone and piping section is overcome when the piping section is withdrawn from a first position in the ground, with the drive cone and piping section in its assembled condition, to a second position in the ground closer to the ground surface than the first position. Such withdrawal leaves the drive cone in place separated from the housing with the permeable material extending from the drive cone toward the bottom end of the hollow piping section in the space separating the drive cone from the housing. Groundwater flows through the permeable material and into the hollow piping section to be withdrawn to the ground surface.

BRIEF DESCRIPTION OF THE DRAWINGS

These and other features, aspects, and advantages of the present invention will be more fully appreciated when considered in connection with the following detailed description and accompanying drawings, wherein.

DETAILED DESCRIPTION

Figure 1:
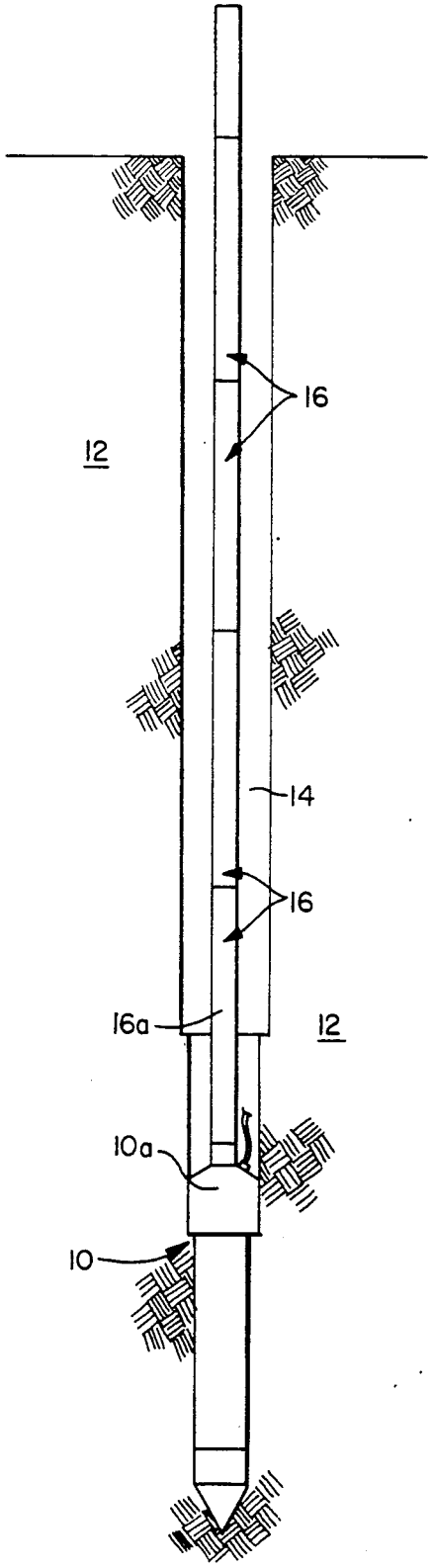
FIG. 1 is a semi-schematic side elevation view of a preferred embodiment of a device provided in accordance with practice of the present invention inserted into the ground for collecting a groundwater sample.

Referring to FIG. 1, there is shown a semi-schematic side elevation view of one embodiment of a device 10 provided in accordance with the present invention which has been inserted into the ground 12 for collection of a groundwater sample. Collection of groundwater samples for analysis enables investigators to determine whether the groundwater has become contaminated by toxic waste or the like and to accurately quantify contaminant levels. By collecting and analyzing samples at various locations at a particular site, the extent of groundwater contamination can be mapped. It is to be understood that, while the device 10 of the present invention is particularly useful for collection of groundwater samples, it can be used for collection of soil gas samples, as well.

To collect the groundwater sample, the device 10 is driven by any of a variety of methods into the ground 12 to a desired depth. The preferred insertion method useful in accordance with the present invention is to drill a bore hole 14 to a selected depth below the ground surface using, for example, a standard drilling rig (not shown). The device 10 is then lowered to the bottom of the bore hole 14 by means of a rod string, i.e., by a series of interconnected rods 16. A first or lowermost rod **16*a* is attached to the top 10*a* of the device 10 with the remaining rods assembled in sequential fashion as the device 10** is lowered into the bore hole. After the device is in place in the bottom of the hole, it is driven into the ground to a desired depth below the bore hole bottom using an impact device or hydraulic ram, or the like. Methods for inserting groundwater sampling devices into the ground are disclosed in my U.S. Pat. No. 4,669,554, which is incorporated herein by this reference.

Figure 2:
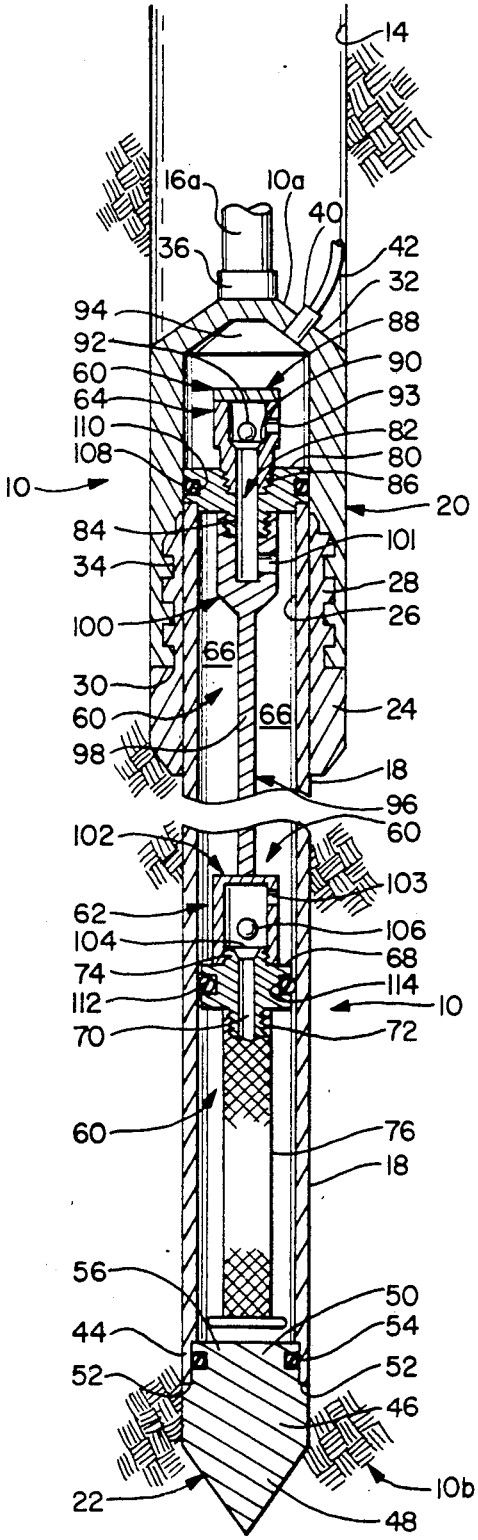
FIG. 2 is a semi-schematic side view, in cross section, of a preferred embodiment of a device provided in accordance with the present invention in a first condition after having been inserted into the ground.
Figure 3:
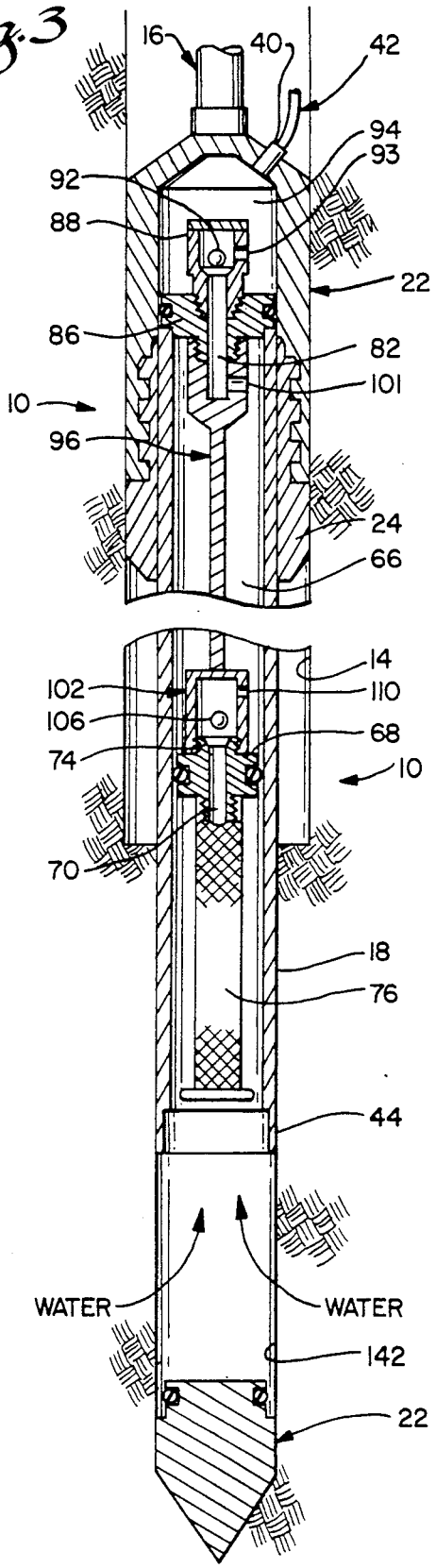
FIG. 3 is a semi-schematic side view, in cross section, of the device of FIG. 2 shown in a second condition for gathering a groundwater sample.

Turning to FIGS. 2 and 3, there are shown semi-schematic side views of a preferred embodiment of the groundwater sampling device 10 provided in accordance with practice of the present invention. Although such a sampling device can be viewed in any position, for purposes of exposition herein, the position of the components of the device relative to each other are described as though the device is inserted into the ground in position to take a sample, for example, as shown in FIGS. 2 and 3. The "top" **10*a* of the device is located nearest the ground surface, and the "bottom" 10*b* of the device is remote from the ground surface. The device 10 includes an elongated hollow housing 18 which can, for example, be fabricated from a section of stainless steel pipe. A closure assembly 20 is mounted on top of the housing 18, and a drive cone 22 is mounted on the bottom end of the housing. FIG. 2 shows the device 10 in a first condition with the drive cone in place on the housing. FIG. 3 shows the device 10** with the drive cone separated from the housing to provide a pathway for water to flow into the housing so that a groundwater sample can be collected.

In the illustrated embodiment, a hollow cylindrical adapter 24 is provided for mounting the closure assembly 20. The adapter is open at both ends and is mounted on the top end 26 of the housing 18 by means of welding or swaging, or the like. The adapter, which, for example, can be made of high carbon steel, incorporates a threaded section 28 on its exterior or outer diameter surface. The closure assembly 20 is hollow and cylindrical in shape, open at its bottom end 30 and closed at its top end 32. Threads 34, which are on the bottom portion of the inside surface of the closure assembly 20, mate with the threads 28 of the adapter 24 when the closure assembly 20 is in place on the housing 18.

A female fitting 36, with its opening facing upwardly, is on the top 32 of the closure assembly 20. Threads (not shown) are on the inside surface of the fitting 36 into which the bottom end of the lowermost or first rod segment 16*a* is threaded. A vent 40 is through the top 32 of the closure assembly 20 for venting both the closure assembly and housing 18 during the water sampling operation. If desired, a vent tube 42, configured to extend from the vent 40 to the ground surface when the device 10 is in position for sampling, is on the vent. The vent tube can be made of various flexible materials, such as rubber, or any of a variety of plastic materials, or the like. In another embodiment, a bore (not shown) is through each of the rods 16 along their centerlines, and a vent (not shown) is provided through the top 32 of the closure assembly along its center line and through the bottom of the fitting 36. The vent through the center of the top 32 registers with the bore in the rods 16 to thereby provide a vent from the interior of the sampling device to the ground surface.

The drive cone 22 is mounted on the open bottom end 44 of the housing 18 by means of frictional engagement between the drive cone and the interior surface of the housing. The drive cone is preferably of cast iron or steel so that it is effective in penetrating the ground. If desired, drive cones of plastics having the appropriate hardness can also be used. The drive cone has a cylindrical center section 46 with a conical section 48 on its bottom end for penetrating the ground. A cylindrical top section 50, having a slightly smaller diameter than the cylindrical center section, extends upwardly away from the center section. A shoulder 52 is defined surrounding the circumference of the drive cone 22 at the junction of the cylindrical center and top sections 46 and 50, respectively. In the illustrated embodiment, the open bottom end 44 of the housing 18 is bored to a slightly larger internal diameter than the remainder of the housing, and the cylindrical top section 50 is press-fit into the bore. In its fully assembled condition, the bottom facing surface of the bottom 44 of the housing abuts the shoulder 52. In one exemplary embodiment, an O-ring 54, which is in a groove 56 around the outer surface of the cylindrical top section 50, provides the frictional engagement between the drive cone 22 and the housing 18. Preferably, the outside diameter of the cylindrical center section of the drive cone 22 is equal to or slightly smaller than the outside diameter of the housing 18.

A water sample collection and containment unit 60 is mounted within the hollow housing 18. The collection/containment unit 60 comprises an inlet assembly 62 adjacent a lower portion of the housing 18, spaced apart from an outlet assembly 64 adjacent an upper portion of the housing. The space 66 between the inlet and outlet assemblies 62 and 64 defines a sample chamber in which the groundwater sample is contained.

In an exemplary embodiment, the inlet assembly 62 includes a cylindrical lower end plug 68 with a bore 70 through its center. The longitudinal axis of the plug 68 is aligned along the length of the longitudinal axis of the housing 18. Externally threaded nipples 72 and 74 extend downwardly and upwardly, respectively, from the plug 68, with the bore 70 extending through the nipples. In the illustrated embodiment, an elongated cylindrical screen 76 is threaded onto the lower or downwardly extending nipple 72 and extends down from the nipple to a location just above the top of the drive cone 22.

The outlet assembly 64 includes a cylindrical upper plug 80 which has a bore 82 through its center. The longitudinal axis of the plug 80 is aligned along the longitudinal axis of the housing 18. A nipple 84, which is threaded on its outer diameter, extends downwardly from the center of the plug 80. The bore 82 extends through the nipple 84. A threaded recess 86 is in the center of the top of the plug 80 and is concentric with the bore 82. A hollow cylindrical check valve housing 88 has a lower threaded end engaged with the threads of the recess 82. A valve seat 90 faces upwardly in the check valve housing to provide a seal when a ball 92 is in the sealing engagement with the seat. The ball 92 and seat 90 provide a one-way check valve to prevent reverse flow of fluids through the valve when the ball is on the seat, i.e., when the valve is closed. An orifice 93 is through the side of the hollow housing 88 to provide a path for water and air through the check valve of the outlet assembly 64 into the interior 94 of the closure assembly when the ball is spaced from the seat and the valve is open. As is described below in greater detail, when the outlet assembly check valve is closed, water is prevented from flowing from the interior 94 of the closure assembly 20 back into the sample chamber 66 around the outside of the plugs.

A connector assembly 96 extends between the lower and upper plugs 68 and 80, respectively. In the illustrated embodiment, the connector assembly 96 includes a connector rod 98 which has an upwardly open, hollow cylindrical extension 100 on its top, which is threaded onto the nipple 84. An orifice 101 is through the side wall of the extension 100 to provide a path for water to flow from the sample chamber 66, through the bore 82, through the upper assembly check valve and out through the orifice 93 into the closure assembly interior 94.

A hollow cylindrical check valve housing 102 is on the bottom of the connector rod 98, with the open end of the housing 102 extending downwardly and threaded onto the nipple 74. An orifice 103 is through the side of the housing 102 to provide a path for water to flow into the sample chamber 66. The top surface 104 of the nipple 74 provides a seating surface or valve seat for a ball 106 in the housing 102. The ball 106 and seat 104 provide a one-way check valve to prevent water from flowing back out from the chamber 66 when the ball is on the seat, i.e., when the check valve is closed.

The upper plug 80 has an O-ring 108 in a groove 110 around its outer perimeter, and the lower plug 68 has an O-ring 112 in a groove 114 around its perimeter. The O-rings 108 and 112 provide a watertight seal between the plugs 68 and 80 and the inner wall of the housing 118 to ensure that water does not escape from the sample chamber 66 around the outside of the plugs.

OPERATION

Referring to FIGS. 2 and 3, to obtain a groundwater sample, the device 10 provided in accordance with the invention is inserted into a bore hole, such as the bore hole 14, so that the drive cone 22 rests at the bottom of the hole. A hydraulic ram or hammer, or the like, is used to impact the top of the rods or rod string 16 to thereby drive the device 10 to a desired depth below the bottom of the bore hole for sampling. (The device 10 is shown at its desired depth below the bottom of the bore hole for taking a groundwater sample in FIG. 2.) Once the sample device 10 has been driven to its desired sampling depth, the device is withdrawn upwardly a selected distance toward the ground surface by raising the pipe string 16. As the pipe string is pulled upwardly, the force exerted by the ground on the drive cone overcomes the frictional engagement between the drive cone and housing. Thus, the drive cone remains in its original position in the ground as the remaining components of the device 10, i.e., the closure assembly 22 and housing 18, are moved to a second position above and separated from the drive cone 22 (best seen in FIG. 3). When the device is in the second position, as shown in FIG. 3, it is in a configuration ready to receive a groundwater sample. The distance between the bottom 44 of the housing 18 and the drive cone 22 can be any desired value, so long as the drive cone has been removed from engagement with the housing to open a pathway for water to flow into the housing bottom and eventually into the sample chamber 66. In relatively impermeable and highly compact soil, it may be desired to separate the housing and drive cone by more than 5 feet, and even more than 10 feet, to enlarge the area from which the ground water sample may flow into the device 10. Being able to provide a desired distance between the drive cone and housing without being constrained to the distance equal to the length of a sample tube, which in prior-art embodiments extends between the drive cone and housing, enables the sample to be obtained more rapidly, especially in low permeability soil.

When the device is in its sampling configuration, hydrostatic pressure forces the groundwater sample to flow upwardly through the screen 76, through the bore 70 in the lower plug 68, through the nipple 74, through the lower housing check valve, and into the check valve housing 102. From the housing 102, the sample flows through the orifice 103 and into the sample chamber 66. As the sample chamber 66 fills with water, the air in the chamber is forced through the upper inlet assembly orifice 101, through the bore 82 in the upper plug 86, through the upper assembly check valve and into the hollow housing 88. From the housing 88, the air flows through the orifice 93 into the cavity or open area 94 inside the closure assembly 22, and finally out through the vent 40 and tube 42. Air flow through the vent tube 42 can be monitored at the ground surface to determine that water is filling the sample chamber. Having a vent tube, such as the tube 42, extending to the ground surface can also be important when drilling mud is used for drilling the bore hole into which the sample device is inserted. For example, when such mud is used, the pressure of the mud can be greater than the hydrostatic pressure of the water at the sample location and, therefore, greater than the pressure of the sample in the sample chamber 66. To prohibit drilling mud from displacing the sample from the chamber 66 when the device is pulled to the surface, the vent tube is clamped shut as the device is withdrawn from its sampling position to the ground surface.

After the groundwater sample is collected, the device 10 is retrieved by pulling the rod string 16 upwardly to the ground surface and sequentially disassembling the rods. As the device is withdrawn, the check valve balls 92 and 106 in the outlet and inlet assemblies, respectively, are seated in sealing engagement with their upstream valve seats, thereby closing the valves. Closure of the lower assembly check valve prevents the water sample from flowing out from the sample chamber 66. Closure of the upper assembly check valve prevents back flow of water from the open housing area 94 into the sample chamber.

Once on the ground surface, the groundwater sample is transferred from the chamber 66 to a container or vial (not shown) by uncoupling the rod segment **16*a* from the closure assembly 22, then unscrewing the assembly 22 to remove it from the adapter 24, inverting the device, and allowing the sample to flow through the outlet assembly 64** into the container.

Figure 4:
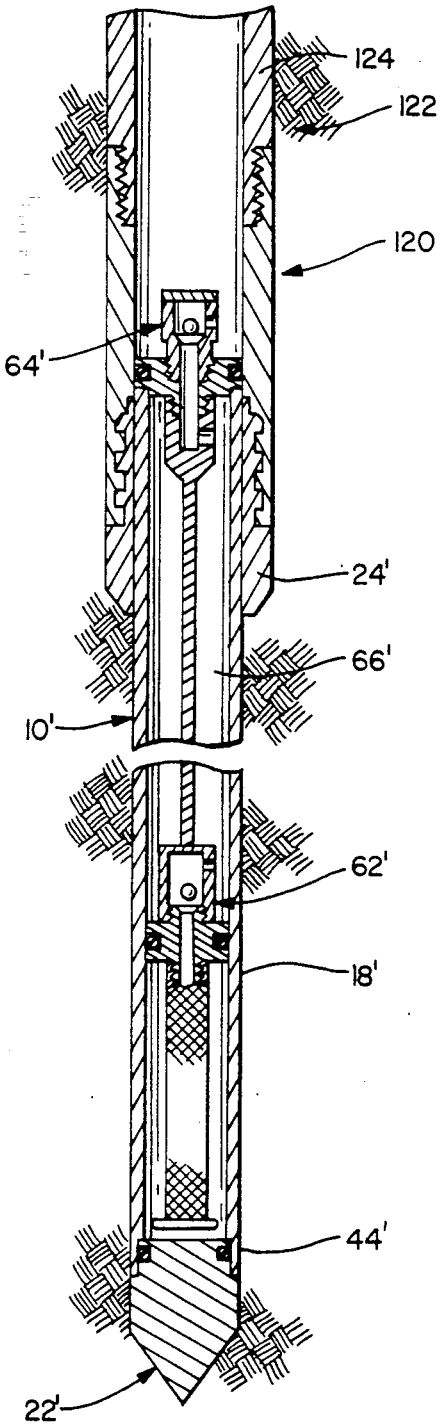
FIG. 4 is a semi-schematic side view, in cross section, of a second preferred embodiment of a device provided in accordance with practice of the present invention.

Turning to FIG. 4, a second preferred embodiment of the sampling device provided in accordance with the present invention is shown. Parts of the device of FIG. 4, which are similar to the parts identified with reference to FIGS. 2 and 3, have the same reference numerals but with a prime (') designation. The device 10, of this embodiment incorporates essentially the same components as the components of the embodiment shown in FIGS. 2 and 3, with the exception that the closure assembly 22 and rods 16 comprising the device 10 are absent from the device 10'. Instead, an open piping section 120 is threaded onto the cylindrical adapter 24', and a pipe string 122 is provided by joining together a plurality of open pipe segments 124. The sample device 10' is lowered to the bottom of an appropriate bore hole in the same manner as is described above with reference to the device 10, except that the pipe segments 124 are used in place of the rods 16. Once in place in the bottom of the bore hole, the device 10' is driven into the ground by means of impacting the uppermost pipe segment 124 of the pipe string 122 with a hammer or hydraulic ram, or the like. After the device 10' has been driven to its desired sampling depth, it is withdrawn upwardly a selected distance toward the ground surface, as was the case for the device 10 discussed with regard to FIGS. 2 and 3. As the pipe string 122 is pulled upwardly to withdraw the device 10', the force exerted by the ground on the drive cone 22' overcomes the frictional engagement between the drive cone 22' and housing 18'. Thus, the drive cone 22' remains in its original position in the ground as the rest of the device 10', i.e., the housing 18', is moved to a second position, above and separated from the drive cone 22'.

When the device 10' is in the second condition, with the drive cone spaced from the end 44' of the housing 18', it is ready to receive a groundwater sample. The sample flows in through the inlet assembly, through the sample chamber 66' and out from the outlet assembly 64' into the piping section 120. The sample can be withdrawn to the ground surface from the piping section 120 by bailing or pumping, or the like. If desired, the piping string may be pulled to the ground surface, thereby pulling the sample chamber to the surface for recovery of the sample in a manner similar to recovery of the sample from the device shown in FIGS. 2 and 3.

Referring again to FIGS. 2 and 3, it is preferred that the water sample collection and containment unit 60 be removably mounted within the hollow housing 18. Such removable mounting is accomplished by providing the unit 60 as an integral unit, as shown. For example, if desired, the unit 60 may be pulled from the housing simply by removing the closure assembly 22 and pulling the unit 60 out from the top end of the housing. Thus, if desired, the embodiment shown in FIG. 4 of the invention can be provided with the collection and containment unit 60 removed.

Figure 5:
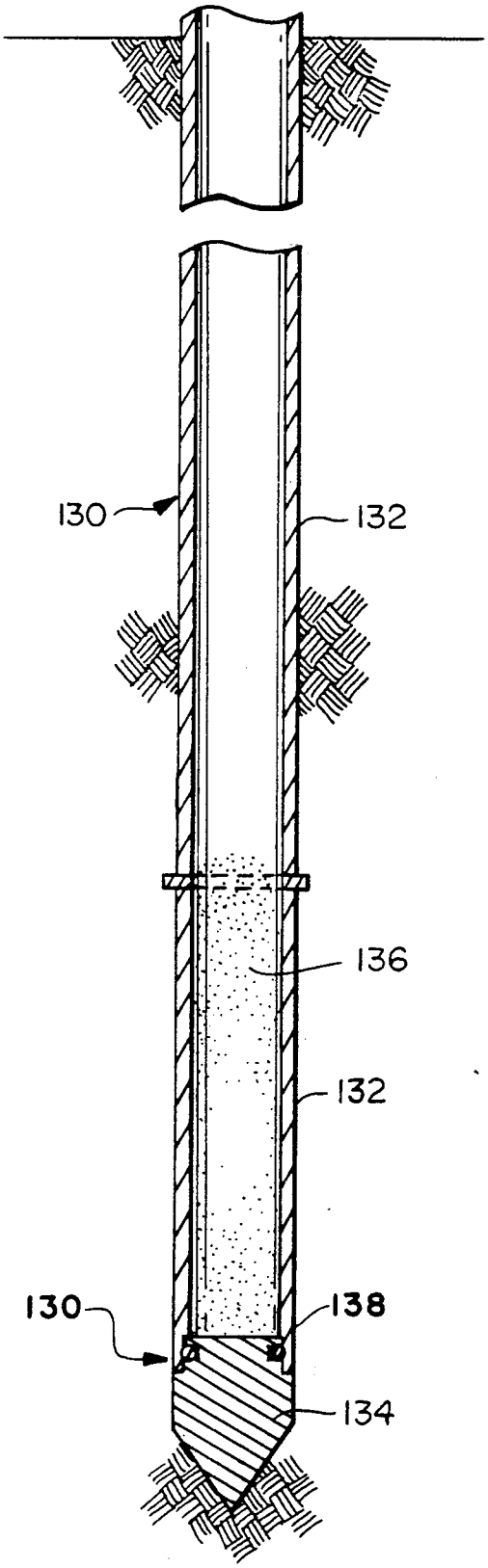
FIG. 5 is a semi-schematic side view, in cross section, of a third preferred embodiment of a device provided in accordance with practice of the present invention in a first condition after having been inserted into the ground.
Figure 6:
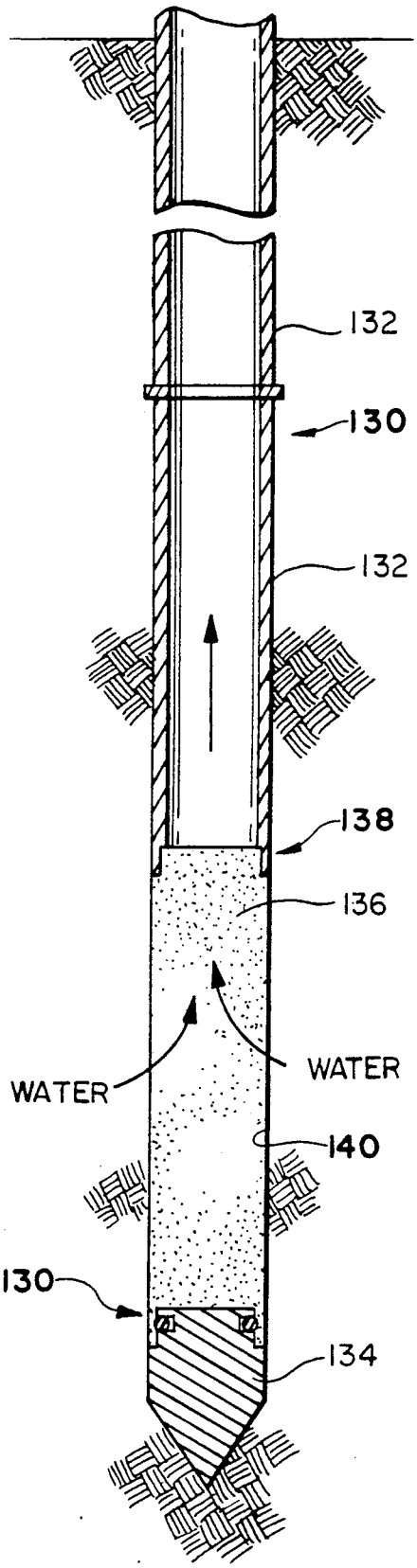
FIG. 6 is a semi-schematic side view, in cross section, of the device of FIG. 5 shown in a second condition for gathering a groundwater sample.

Referring to FIGS. 5 and 6, there is shown yet another preferred embodiment of a groundwater sampling device 130 provided in accordance with practice of principles of the present invention. The device 130 includes at least one elongated hollow piping section 132 through which a groundwater sample can flow to the ground surface. A drive cone 134, adapted to penetrate the ground, is removably mounted by means of frictional engagement on the bottom end of the lowermost hollow piping section 132. A quantity of permeable material 136, for example, sand, fills at least a portion of the lowermost hollow piping section 132.

Once the sample device 130 has been driven to its desired sampling depth, the device is withdrawn upwardly a selected distance toward the ground surface. As the piping section 132 is pulled upwardly to withdraw the device 130, the force exerted by the ground on the drive cone 134 overcomes the frictional engagement between the drive cone and piping section 132. Thus, the drive cone remains in its original position in the ground as the piping section is withdrawn to a second position in the ground closer to the ground surface than the first position. As is best seen in FIG. 6, when in the second or sampling position, the drive cone 134 is separated from the bottom of the piping section 132. The sand 136, which was in the housing 132, now extends from the drive cone 134 toward the bottom 138 of the hollow piping section in the space 140 separating the drive cone from the housing.

With the device 130 in its second position (shown in FIG. 6), a groundwater sample can flow through the sand and into the hollow piping section 132 to be withdrawn to the ground surface. For example, the water can be bailed to the ground surface from the piping section using a bailing device, or the water can be pumped from the piping section 132 to the ground surface.

If desired, a permeable material, such as sand, can be used in the embodiments of the device 10 shown in FIGS. 2 and 3. Turning to FIG. 2, when sand is used, it is placed in the housing 18 between the drive cone and the bottom of the plug 68. As is the case in the embodiment described with respect to FIGS. 5 and 6, when the drive cone 22 is separated from the housing 18 (as shown in FIG. 3), the sand (not shown) extends from the drive cone 22 toward the bottom of the hollow housing 18 in the space 142 separating the drive cone from the housing.

As can be appreciated, devices provided in accordance with the present invention provide an inexpensive method and mechanism for retrieval of groundwater samples. There are no sampling tubes or the like provided which must telescope repeatedly into and out from a housing during each successive use. Thus, because such devices have essentially no moving parts subject to damage, they require little, if any, repair. Furthermore, such devices can be withdrawn and thereby separated any desired distance from the drive cone so that, in impermeable soil, the area from which a sample can be taken can be of any desired magnitude, thereby speeding up the sampling process.

The above description of preferred embodiments of groundwater sampling devices provided in accordance with this invention is for illustrative purposes. Because of variations which will be apparent to those skilled in the art, the present invention is not intended to be limited to the particular embodiments described above. For example, if desired, the inlet and outlet assemblies of the collection and containment unit need not be connected together. The scope of the invention is defined in the following claims.

What is claimed is:

1. A device adapted to be inserted into the ground for obtaining a groundwater sample, the device comprising:

a) an elongated hollow housing;

b) a drive cone removably mounted by means of frictional engagement on the bottom end of the housing, the drive cone adapted to penetrate the ground and configured to be restrained by the ground once in place below the ground surface so that the frictional engagement between the drive cone and housing is overcome when the housing is withdrawn from the ground toward the ground surface, thereby leaving the drive cone in place separated from the housing; and c) a sample collection and containment unit removably mounted within the hollow housing, the collection and containment unit comprising an inlet assembly adjacent the bottom end of the housing spaced from an outlet assembly adjacent the top end of the housing, wherein the space between the inlet and outlet assemblies define a sample chamber, wherein the inlet assembly includes a one-way check valve through which a water sample can flow from the ground into the sample chamber when the drive cone has been separated from the housing, and wherein the outlet assembly includes a one-way check valve through which water can flow out from the chamber.

2. The device of claim 1 wherein the inlet assembly additionally includes a screen mounted on the inlet side of the inlet check valve so that the water sample must pass through the screen and then through the inlet check valve and into the sample chamber.

3. The device of claim 1 additionally comprising a guantity of sand contained in the space between the drive cone and the inlet assembly check valve.

4. A device adapted to be inserted into the ground for obtaining a groundwater sample, the device comprising:

a) an elongated hollow housing;

b) a closure assembly mounted on the top end of the housing;

c) a drive cone removably mounted by means of frictional engagement on the bottom end of the housing, the drive cone adapted to penetrate the ground and configured to be restrained by the ground once in place below the ground surface so that the frictional engagement between the drive cone and housing is overcome when the closure assembly and housing are withdrawn from the ground toward the ground surface, thereby leaving the drive cone in place separated from the housing; and d) a sample collection and containment unit mounted within the hollow housing and closure assembly, the collection and containment unit comprising an inlet assembly adjacent the bottom end of the housing spaced from and connected to an outlet assembly adjacent the top end of the housing, wherein the space between the inlet and outlet assemblies defines a sample chamber, wherein the inlet assembly includes a one-way check valve so that a water sample flows from the ground through the check valve and into the sample chamber when the drive cone has been separated from the housing, and wherein the outlet assembly includes a one-way check valve through which water can flow out from the sample chamber.

5. The device of claim 4 additionally comprising means for venting the hollow housing and closure assemblies.

6. The device of claim 5 wherein the venting means comprises a vent tube which is configured to extend from a connector on the closure assembly which is open to the interior of the closure assembly to the ground surface when the sampling device is in position for sampling.

7. The device of claim 4 wherein the inlet assembly additionally includes a screen mounted on the inlet side of the inlet check valve so that the water sample can flow through the screen and then through the inlet check valve and into the sample chamber.

8. The device of claim 4 wherein the sample collection and containment unit is removably mounted within the space defined by the hollow housing and closure assemblies.

9. The device of claim 4 additionally comprising a guantity of sand contained, in the space between the drive cone and the inlet assembly check valve.

* * * * *

UNITED STATES PATENT AND TRADEMARK OFFICE

CERTIFICATE OF CORRECTION

PATENT NO. : 5,046,568

DATED : September 10, 1991

INVENTOR(S) : Kent E. Cordry

It is certified that error appears in the above-identified patent and that said Letters Patent is hereby corrected as shown below:

Title page, under [57] ABSTRACT, "elonagated" should be -- elongated --;
at column 1, line 14, after "deleterious", "affect" should be -- effect --;
at column 10, line 38, "guantity" should be -- quantity --; and
at column 12, line 11, "guantity" should be -- quantity --.

Signed and Sealed this

Sixteenth Day of March, 1993

*Attest:*

STEPHEN G. KUNIN

*Attesting Officer*

*Acting Commissioner of Patents and Trademarks*